US009707616B2

(12) United States Patent
Nagata

(10) Patent No.: US 9,707,616 B2
(45) Date of Patent: Jul. 18, 2017

(54) FORM ROLLING APPARATUS AND FORM ROLLING METHOD

(71) Applicant: AISIN SEIKI KABUSHIKI KAISHA, Kariya-shi (JP)

(72) Inventor: Eiri Nagata, Toyoake (JP)

(73) Assignee: AISIN SEIKI KABUSHIKI KAISHA, Kariya-shi (JP)

( * ) Notice: Subject to any disclaimer, the term of this patent is extended or adjusted under 35 U.S.C. 154(b) by 199 days.

(21) Appl. No.: 14/518,642

(22) Filed: Oct. 20, 2014

(65) Prior Publication Data

US 2015/0183021 A1 Jul. 2, 2015

(30) Foreign Application Priority Data

Dec. 27, 2013 (JP) ..... 2013-271008

(51) Int. Cl.
*B21D 53/28* (2006.01)
*B21H 5/02* (2006.01)
(Continued)

(52) U.S. Cl.
CPC ..... *B21H 5/02* (2013.01); *B21B 1/16* (2013.01); *B21B 39/26* (2013.01); *B21H 5/022* (2013.01); *Y10T 29/49467* (2015.01)

(58) Field of Classification Search
CPC .. B21H 5/00; B21H 5/02; B21H 5/022; B21B 39/26; B21B 1/16; Y10T 29/4967; Y10T 29/49467
(Continued)

(56) References Cited

U.S. PATENT DOCUMENTS 5,918,495 A 7/1999 Miyamoto et al.
6,418,767 B2 * 7/2002 Shinbutsu ..... B21H 1/00 72/10.2
(Continued)

FOREIGN PATENT DOCUMENTS

EP 0 761 339 A2 3/1997
JP 59-97731 6/1984

OTHER PUBLICATIONS

Extended European Search Report issued Jun. 24, 2015 in Patent Application No. 14188069.0.
(Continued)

*Primary Examiner* — David B Jones
(74) *Attorney, Agent, or Firm* — Oblon, McClelland, Maier & Neustadt, L.L.P.

(57) ABSTRACT

A form rolling apparatus for applying in-feed form rolling to a rod-shaped material includes a support portion configured to support the rod-shaped material to be axially rotatable, a round die formed with die teeth on an outer periphery thereof, the die teeth configured to be positioned facing an outer periphery surface of the rod-shaped material, and a moving device moving the round die so that a distance of axes of the round die and the rod-shaped material changes. The die teeth includes forming die teeth for generating gear teeth on the outer periphery surface of the rod-shaped material and finishing die teeth enhancing a tooth surface precision of the generated gear teeth by engaging with the generated gear tooth and rotating. The finishing die teeth are formed in a configuration each having an addendum that does not come to contact a bottom land of the generated gear teeth.

5 Claims, 7 Drawing Sheets

(51) Int. Cl.
*B21B 1/16* (2006.01)
*B21B 39/26* (2006.01)

(58) Field of Classification Search
USPC ..... 72/108
See application file for complete search history.

(56) References Cited

U.S. PATENT DOCUMENTS

| | | | | |
|---|---|---|---|---|
| 6,779,270 | B2 * | 8/2004 | Sonti | B21H 5/022 29/893.3 |
| 8,156,779 | B2 * | 4/2012 | Ohashi | H01T 21/02 72/10.7 |
| 2004/0173000 | A1 | 9/2004 | Monot | |

OTHER PUBLICATIONS

Eiri Nagata, et al., Form Rolling of Helical Gear with Small Number of Teeth and Large Helix Angle (Reduction of Work Piece Shift), Transactions of the Japan Society of Mechanical Engineers 79(798), 2013, 11 pgs.

Eiri Nagata, et al., "Form Rolling of Helical Gear with Small Number of Teeth and Large Helix Angle (Geometrical Discussion on Form Deviation Caused by Die Penetration)", Transactions of the Japan Society of Mechanical Engineers 79(807), 2013, 13 pgs.

* cited by examiner

FORM ROLLING APPARATUS AND FORM ROLLING METHOD

CROSS REFERENCE TO RELATED APPLICATIONS

This application is based on and claims priority under 35 U.S.C. §119 to Japanese Patent Application 2013-271008, filed on Dec. 27, 2013, the entire content of which is incorporated herein by reference.

TECHNICAL FIELD

This disclosure generally relates to a form rolling apparatus and a form rolling method.

BACKGROUND DISCUSSION

Form rolling is a manufacturing method that applies deformation processing on an outer peripheral surface of a rod-shaped material by driving a form rolling die in a state where die teeth that are formed on a form rolling die are pressed against the outer peripheral surface of the rod-shaped material. Generally, a rack die or a round die is applied as the form rolling die. The form rolling is widely applied for forming, for example, a helical gear, a screw, a down-sized worm, and a spline, as the manufacturing method that is environment-friendly, is highly productive, and is with low manufacturing costs.

The form rolling includes two types of manufacturing methods, which are, in-feed form rolling and incremental rolling. According to the in-feed form rolling, the die teeth of the form rolling die penetrate the outer peripheral surface of the rod-shaped material while gradually reducing a distance between the center of the rod-shaped material and the form rolling die to form a teeth portion on the outer peripheral surface of the rod-shaped material. Thus, in case of applying a round die for the in-feed form rolling, normally, die teeth having the same configurations are provided on the round die over an entire circumference of the round die. On the other hand, according to the incremental rolling, a teeth portion is formed on the outer peripheral surface of the rod-shaped material while maintaining a distance between the center of the rod-shaped material and the form rolling die to be constant. A form rolling die which is applied for the incremental form rolling is formed with die teeth having different configurations along an operational direction thereof. Thus, in case of applying a round die to the incremental form rolling, die teeth with different configurations are provided along a circumferential direction of the round die. Then, the outer peripheral surface of the rod-shaped material is applied with the form rolling to follow changes in the configuration of the die teeth.

JPS59-97731A (i.e., hereinafter referred to as Patent reference 1) discloses a form rolling apparatus which forms helical teeth on an outer peripheral surface of a rod-shaped material by in-feed form rolling. The form rolling apparatus disclosed in Patent reference 1 includes a support portion that supports a rod-shaped material to be axially rotatable, and a round die formed with die teeth on an outer periphery and positioned so that the die teeth face an outer peripheral surface of the rod-shaped material supported by the support portion. The following reference discloses an analysis of a process for the transition of contact states of a round die and a rod-shaped material from a rolling contact with friction state to a gear meshing contact state according to in-feed form rolling of the rod-shaped material and a method for reducing a work piece shift (axial motion) of the rod-shaped material in accordance with the transition of the contact states: Eiri NAGATA, Yoshitomo NAKAHARA, Morimasa NAKAMURA and Ichiro MORIWAKI. "Form Rolling of Helical Gear with Small Number of Teeth and Large Helix Angle (Reduction of Work Piece Shift)" Transactions of the Japan Society of Mechanical Engineers 79(798), 371-381 (hereinafter referred to as Non-patent reference 1). The following reference discloses numerical analysis of mechanism of the generation of form deviation during in-feed form rolling of the rod-shaped material: Eiri NAGATA, Tomokazu TACHIKAWA, Morimasa NAKAMURA and Ichiro MORIWAKI. "Form Rolling of Helical Gear with Small Number of Teeth and Large Helix Angle (Geometrical Discussion on Form Deviation Caused by Die Penetration)" Transactions of the Japan Society of Mechanical Engineers 79(807), 367-379 (hereinafter referred to as Non-patent reference 2).

Non-patent reference 2 confirms that, for example, a tooth profile deviation and/or undulation of a tooth trace is generated on a processed, or generated gear tooth (teeth) because of the die penetration of the round die to the rod-shaped material according to the in-feed form rolling using the round die. Non-patent reference 2 further discloses a method to cancel the undulation of the tooth trace by intentionally changing an axial phase of the round die and the rod-shaped material during the form rolling. According to this method, a certain effects for canceling the undulation of the tooth trace is attained, however, is not sufficient.

A need thus exists for a form rolling apparatus and form rolling method which is not susceptible to the drawback mentioned above.

SUMMARY

In light of the foregoing, the disclosure provides a form rolling apparatus for applying in-feed form rolling to an outer periphery surface of a rod-shaped material to generate helical gear teeth. The form rolling apparatus includes a support portion configured to support the rod-shaped material to be axially rotatable, a round die formed with die teeth on an outer periphery thereof, the round die being rotatable about a rotational axis which is configured to be arranged in parallel with an axial direction of the rod-shaped material configured to be supported by the support portion, the die teeth configured to be positioned facing the outer periphery surface of the rod-shaped material configured to be supported by the support portion, a rotation drive device rotationally actuating the round die, and a moving device moving the round die in a direction orthogonal to the rotational axis of the round die so that a distance of axes of the round die and the rod-shaped material changes. The die teeth includes forming die teeth for generating the gear teeth on the outer periphery surface of the rod-shaped material and finishing die teeth enhancing a tooth surface precision of the generated gear teeth by engaging with the generated gear tooth and rotating. The finishing die teeth are formed in a configuration each having an addendum that does not come to contact a bottom land of the generated gear teeth.

According to another aspect of the disclosure, a form rolling method for applying in-feed form rolling to an outer periphery surface of a rod-shaped material to form helical gear teeth, the form rolling method includes a forming process for generating the gear teeth on the outer periphery surface of the rod-shaped material by forming die teeth which are formed on an outer periphery of a round die penetrating in a radially inward of the rod-shaped material at the outer periphery surface of the rod-shaped material while rotating the round die in a state where the forming die teeth are in contact with the outer periphery surface of the rod-shaped material which is rotatably supported, and a finishing process for enhancing a tooth surface precision of the generated gear teeth by rotating the round die in a state where finishing die teeth formed on the outer periphery of the round die are engaged with the generated gear teeth generated on the outer periphery surface of the rod-shaped material. The finishing die teeth and the generated gear teeth are engaged so that an addendum of each of the finishing die teeth does not come to contact a bottom land of the generated gear teeth in the finishing process.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

One embodiment of a form rolling apparatus and form rolling method will be explained with reference to illustrations of drawing figures as follows.

Figure 1:
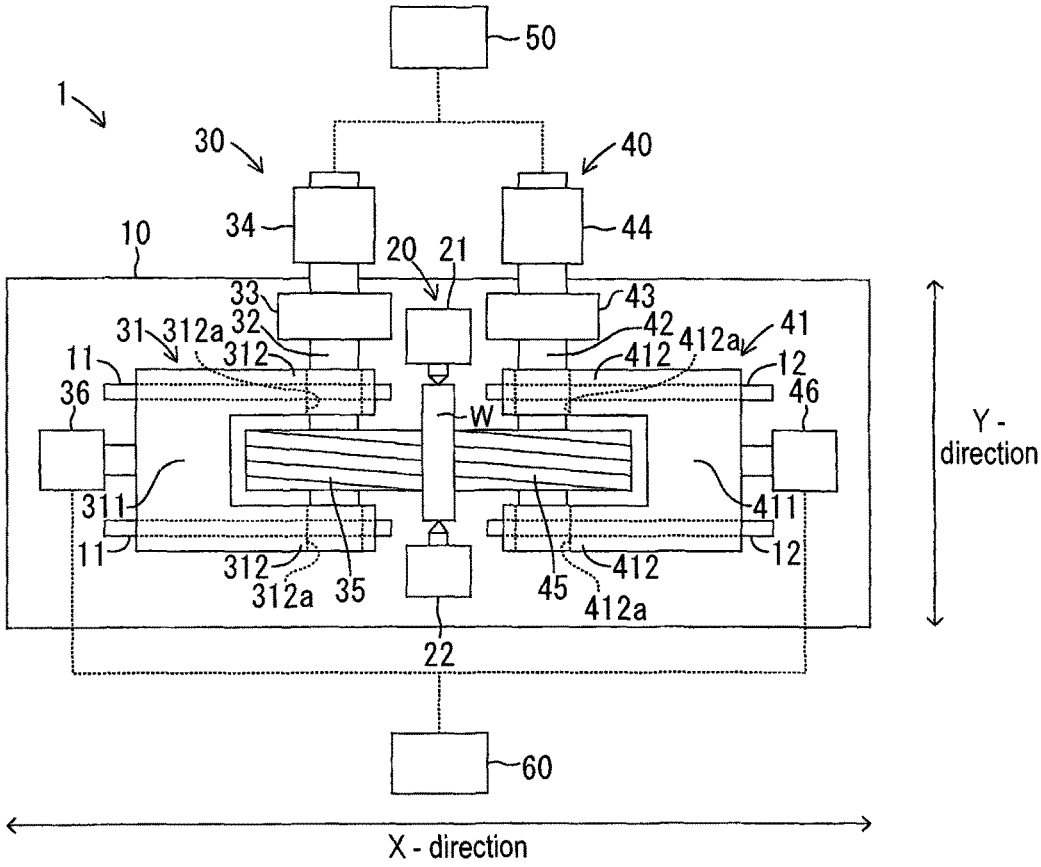
FIG. 1 is a schematic plane view of a form rolling apparatus according to an embodiment disclosed here.

As illustrated in FIG. 1, a form rolling apparatus 1 includes a base plate 10, a support portion 20, a first die unit 30, a second die unit 40, a rotation control device 50, and a position control device 60.

As shown in FIG. 1, the base plate 10 is formed in a substantially rectangular shape in a plane view. A longitudinal direction (i.e., right-left direction in FIG. 1) of the base plate 1 is defined in an X-direction and a direction that is orthogonal to the X-direction (an up-down direction in FIG. 1) is defined as a Y-direction for an explanatory purpose. A direction that is orthogonal to the X-direction and the Y-direction is an up-down direction.

The support portion 20 is provided on the base plate 10. The support portion 20 includes a headstock 21 and a tailstock 22. The headstock 21 and the tailstock 22 are positioned at a substantially center position in the longitudinal direction (X-direction) of the base plate 10 keeping a predetermined distance from each other in the Y-direction.

Figure 2:
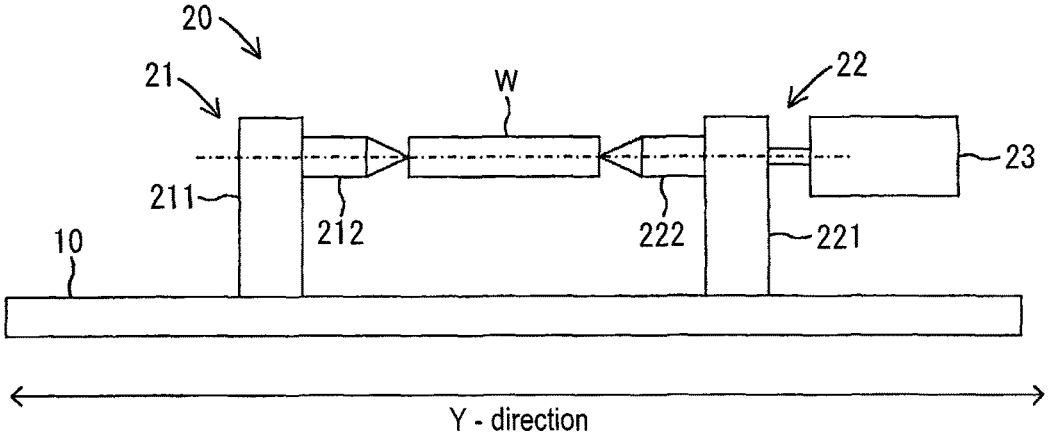
FIG. 2 is a view showing a support portion viewed in an X-direction.

As illustrated in FIG. 2, the headstock 21 includes a first pillar portion 211 standingly provided on the base plate 10 in an upward direction, and a first centering pin 212 supported at an upper portion of the first pillar portion 211 and extending in the Y-direction. Similarly, the tailstock 22 includes a second pillar portion 221 standingly provided on the base plate 10 in an upward direction, and a second centering pin 222 supported at an upper portion of the second pillar portion 221 and extending in the Y-direction. The first centering pin 212 and the second centering pin 222 are coaxially arranged so that ends of the first centering pin 212 and the second centering pin 222 face each other.

The first centering pin 212 is supported by the first pillar portion 211 so as not to move in an axial direction (Y-direction). On the other hand, the second centering pin 222 is supported by the second pillar portion 221 to be movably in the axial direction (Y-direction). An air cylinder 23 is connected to a rear end portion of the second centering pin 222. The second centering pin 222 is biased in a direction to approach the first centering pin 212 by the application of the air pressure of the air cylinder 23 to the second centering pin 222.

A rod-shaped material W is provided between the first centering pin 212 and the second centering pin 222. The rod-shaped material W is supported by the support portion 20 to be rotatably about an axis by receiving the biasing force from the air cylinder 23 in a state where a first end surface of the rod-shaped material W is in contact with the end of the centering pin 212 and a second end surface of the rod-shaped material W is in contact with the end of the second centering pin 222.

As illustrated in FIG. 1, the first die unit 30 and the second die unit 40 are positioned opposing each other in the X-direction while interposing the rod-shaped material W supported by the support portion 20 therebetween when viewed in the plane view. The first die unit 30 includes a first holder 31, a first rotational axis 32, a first speed reducer 33, a first motor (serving as a rotation drive device) 34, a first round die 35, and a first hydraulic pressure cylinder (serving as a moving device) 36. The second die unit 40 includes a second holder 41, a second rotational axis 42, a second speed reducer 43, a second motor (serving as a rotation drive device) 44, a second round die 45, and a second hydraulic pressure cylinder (serving as a moving device) 46.

A first guide rail 11 structured with two ridges which are arranged in parallel to each other and a second guide rail 12 structured with two ridges which are arranged in parallel to each other are provided on a top surface of the base plate 10. The first guide rail 11 and the second guide rail 12 are extended in the X-direction. The first guide rail 11 and the second guide rail 12 are arranged opposite from each other relative to the rod-shaped material W supported by the support portion 20 when viewing the form rolling apparatus 1 in the plane direction. The first holder 31 of the first die unit 30 is provided at the first guide rail 11 so as to be movable in the X-direction and so as not to be movable in other directions. The second holder 41 of the second die unit 40 is provided at the second guide rail 12 so as to be movable in the X-direction and so as not to be movable in other directions. That is, the first holder 31 and the second holder 41 are positioned on the base plate 10 so as to be movable in the X-direction.

The first holder 31 includes a body 311 extending in the Y-direction and a pair of arm portions 312, 312 extending in the X-direction from ends of the body 311 in the Y-direction. As illustrated in FIG. 1, the first holder 31 includes a U-shaped configuration when viewed in the plane. Similarly, the second holder 41 includes a body 411 extending in the Y-direction and a pair of arm portions 412, 412 extending in the X-direction from ends of the body 411 in the Y-direction. The arm portions 412, 412 are in parallel to each other. As illustrated in FIG. 1, the second holder 41 includes a U-shaped configuration when viewed in plane. Then, the first holder 31 and the second holder 41 are positioned on the base plate 10 so that ends of the arm portions 312, 312 of the first holder 31 and ends of the arm portions 412, 412 of the second holder 41 are opposed to each other, respectively.

Circular holes 312*a*, 312*a* are coaxially formed on the arm portions 312, 312, respectively, of the first holder 31. A first rotation shaft 32 is positioned through the circular holes 312*a*, 312*a*. The first rotation shaft 32 is rotatably supported by the first holder 31 via a bearing member, for example, a bearing attached to an inner peripheral wall of the circular holes 312*a*, 312*a*. Similarly, circular holes 412*a*, 412*a* are coaxially formed on the arm portions 412, 412, respectively, of the second holder 41. A second rotation shaft 42 is positioned through the circular holes 412*a*, 412*a*. The second rotation shaft 42 is rotatably supported by the second holder 41 via a bearing member, for example, a bearing attached to an inner peripheral wall of the circular holes 412*a*, 412*a*. An axial direction of the first rotation shaft 32 supported by the first holder 31 and an axial direction of the second rotation shaft 42 supported by the second holder 41 are in parallel with an axial direction (Y-direction) of the rod-shape member W supported by the support portion 20.

The first motor 34 is connected to a first end of the first rotation shaft 32 via the first speed reducer 33. Similarly, the second motor 4 is connected to a first end of the second rotation shaft 42 via the second speed reducer 43. By the actuation of the first motor 34, the first rotation shaft 32 axially rotates. By the actuation of the second motor 44, the second rotation shaft 42 axially rotates.

The first round die 35 is coaxially and integrally rotatably attached to the first rotation shaft 32, and the second round die 45 is coaxially and integrally rotatably attached to the second rotation shaft 42. The first round die 35 is attached to the first rotation shaft 32 so that the first round die 35 is disposed between the arm portions 312, 312 of the first holder 31. The second round die 45 is attached to the second rotation shaft 42 so that the second round die 45 is disposed between the arm portions 412, 412 of the second holder 41.

As illustrated in FIG. 1, the first round die 35 and the second round die 45 are positioned to oppose to each other in the X-direction while interposing the rod-shaped material W supported by the support portion 20 therebetween. Further, as described above, the axial directions of the first rotation shaft 32, the second rotation shaft 42, and the rod-shaped material W are in parallel to one another. That is, the first round die 35 and the second round die 45 are rotatable about rotational axes that are in parallel with the axial direction (Y-direction) of the rod-shaped material W supported by the support portion 20. Further, the first round die 35 and the second round die 45 are attached to the first rotation shaft 32 and the second rotation shaft 42, respectively, in a manner that the first round die 35 and the second round die 45 are arranged at the same position to each other in the Y-direction. Thus, an outer peripheral surface of the first round die 35 and an outer peripheral surface of the second round die 45 face an outer peripheral surface of the rod-shaped material W supported by the support portion 20 at the same position to each other in the Y-direction.

In a case where the form rolling apparatus 1 is in an initial state (i.e., a state before starting the form rolling), the outer peripheral surface of the first round die 35 and the outer peripheral surface of the rod-shaped material W supported by the support portion 20 are separated from each other, and the outer peripheral surface of the second round die 45 and the outer peripheral surface of the rod-shaped material W supported by the support portion 20 are separated from each other. Further, an upward-downward directional position of the rotation axis of the first round die 35, an upward-downward directional position of the rotation axis of the second round die 45, and an upward-downward directional position of the rotation axis of the rod-shaped material W are equal to one another (the first round die 35, the second round die 45, and the rod-shaped material W are positioned at the same upward-downward directional position, or height). Further, in the initial state, a distance of axes of the first round die 35 and the rod-shaped material W supported by the support portion 20 and a distance of axes of the second round die 45 and the rod-shaped material W supported by the support portion 20 are the same. In those circumstances, the distance of axes corresponds to a distance between a rotation center of the round die (first round die 35 or second round die 45) and a rotation center of the rod-shaped material W supported by the support portion 20 in the X-direction.

A cylinder rod of the first hydraulic pressure cylinder 36 is connected to the body 311 of the first holder 31. The cylinder rod of the first hydraulic pressure cylinder 36 is configured to expand and contract in the X-direction. Thus, by the actuation of the first hydraulic pressure cylinder 36, the first holder 31 moves in the X-direction. When the first holder 31 moves in the X-direction, the first rotation shaft 32 supported by the first holder 31 and the first round die 35 attached to the first rotation shaft 32 move in the X-direction. By moving the first round die 35 in the X-direction, that is, in the direction orthogonal to the rotation axis direction (Y-direction) of the first round die 35, the distance of axes of the first round die 35 and the rod-shaped material W supported by the support portion 20 changes.

A cylinder rod of the second hydraulic pressure cylinder 46 is connected to the body 411 of the second holder 41. The cylinder rod of the second hydraulic pressure cylinder 46 is configured to expand and contract in the X-direction. Thus, by the actuation of the second hydraulic pressure cylinder 46, the second holder 41 moves in the X-direction. When the second holder 41 moves in the X-direction, the second rotation shaft 42 supported by the second holder 41 and the second round die 45 attached to the second rotation shaft 42 move in the X-direction. By moving the second round die 45 in the X-direction, that is, in the direction orthogonal to the rotation axis direction (Y-direction) of the second round die 45, the distance of axes of the second round die 45 and the rod-shaped material W supported by the support portion 20 changes.

According to the embodiment, in association with the motion of members in the X-direction based on the actuation of the first hydraulic pressure cylinder 36 and the second hydraulic pressure cylinder 46, a motion in a direction approaching the rod-shaped material W supported by the support portion 20 is defined as a forward movement, and a motion in a direction retracting from the rod-shaped material W supported by the support portion 20 is defined as a retracting movement.

The actuations of the first motor 34 and the second motor 44 are controlled by the rotation control device 50. Further, the actuations of the first hydraulic pressure cylinder 36 and the second hydraulic pressure cylinder 46 are controlled by the position control device 60.

Figure 3:
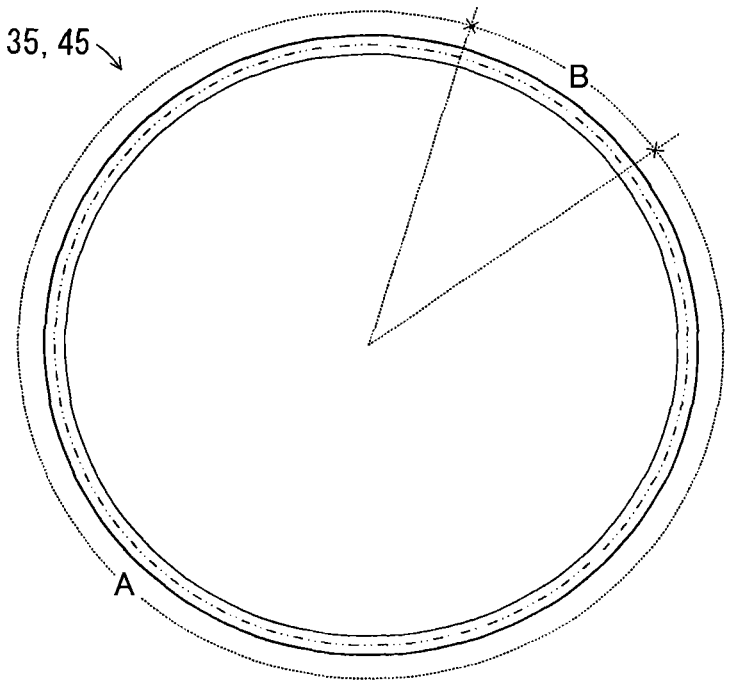
FIG. 3 is a front view of a round die.

The first round die 35 and the second round die 45 have the same configuration. FIG. 3 is a front view (end surface view) of the first round die 35 and the second round die 45 (hereinafter, referred to as round dies 35, 45 when generally referring to the first round die 35 and the second round die 45). Each of the round dies 35, 45 is formed in a disc shape or a pillar shape, and is formed with die teeth on the outer periphery surface thereof. Accordingly, the round dies 35, 45 are positioned relative to the rod-shaped material W supported by the support portion 20 so that the die teeth formed on the outer periphery surfaces face the outer periphery surface of the rod-shaped material W. According to the embodiment, forming die teeth and finishing die teeth are formed on each of the outer periphery surfaces of the round dies 35, 45 along each of circumferential directions. In those circumstances, as illustrated in FIG. 3, the outer periphery (outer circumference) of the round dies 35, 45 includes a first outer periphery region A and a second outer periphery region B. The forming die teeth are formed on the first outer periphery region A and the finishing die teeth are formed on the second outer periphery region B. As illustrated in FIG. 3, the length of the first outer periphery region A is longer than the length of the second outer periphery region B.

Figure 4:
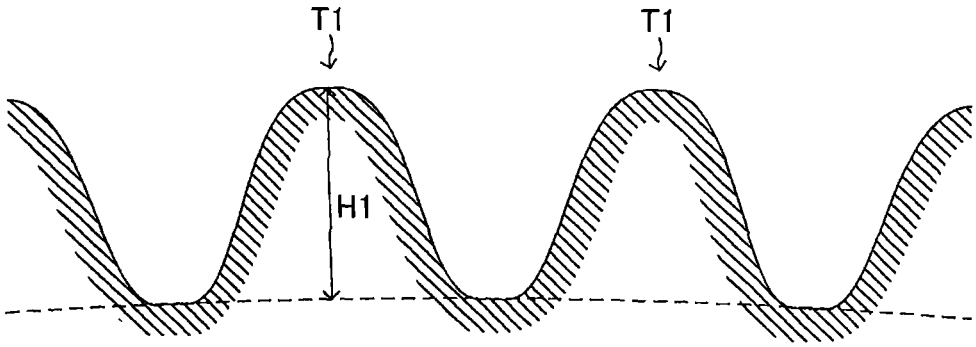
FIG. 4 shows a configuration of forming die teeth formed on a first outer peripheral area.
Figure 5:
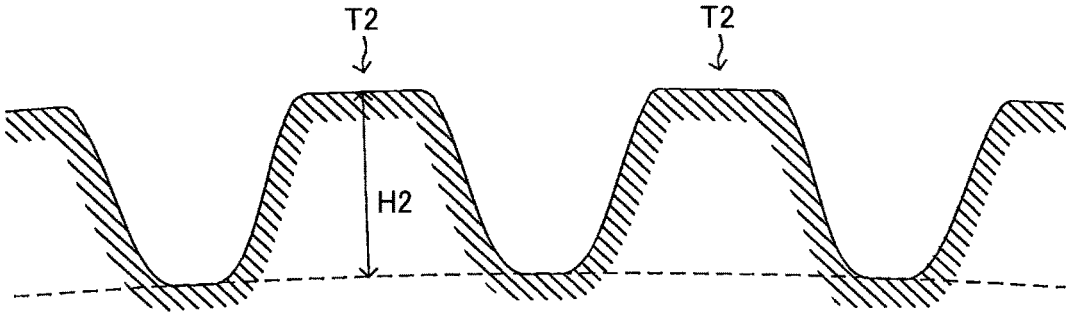
FIG. 5 shows a configuration of finishing die teeth formed on a second outer peripheral area.

FIG. 4 shows the configuration of the forming die teeth T1 formed on the first outer periphery region A. FIG. 5 shows the configuration of the forming die teeth T2 formed on the second outer periphery region B. As illustrated in FIG. 4, the forming die teeth T1 includes tooth profile for form rolling a helical gear. A tooth depth of the forming die teeth T1 is defined as H1 in FIG. 4. As illustrated in FIG. 5, a tooth depth H2 of the finishing die teeth T2 is shorter than the tooth depth of the forming die teeth T1.

Figure 6:
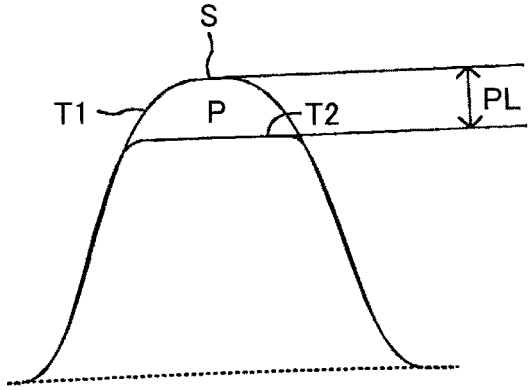
FIG. 6 shows the forming die tooth and the finishing die tooth being overlapped with each other for an explanatory purpose.

FIG. 6 shows the forming die tooth T1 and the finishing die tooth T2 overlapped to each other for an explanatory purpose. As illustrated in FIG. 6, the forming die tooth T1 and the finishing die tooth T2 have the same configuration except for an addendum portion. That is, the finishing die tooth T2 is formed in a configuration in which an addendum region P, which is the region extending from a top land S (including the top land S) by a predetermined length PL along the tooth depth direction, is cut out from a tooth having the same configuration with the forming die tooth T1. Thus, the forming die tooth T1 and the finishing die tooth T2 include the common tooth profile and dedendum configuration to each other, and have different addendum portion configurations. In order to form dies for forming two types of die teeth (forming die teeth T1 and finishing die teeth T2) at different regions in a circumferential direction, first, die teeth having the same configuration with the forming die teeth T1 are formed on an entire circumference of a die material having a disc shape. Then, the addendum region P of the die teeth formed on the second outer periphery region B is formed by cutting. Accordingly, the round dies 35, 45 each of which is formed with the forming die teeth T1 in the first outer periphery region A and the finishing die teeth T2 in the second outer periphery region B can be readily manufactured.

In those circumstances, in a case where the addendum region P is excessively cut, steps or burr may be generated at dedendum portion (root portion) of the generated gear tooth (teeth) (i.e., the tooth/teeth formed on the outer periphery surface of the rod-shaped material W) during the finishing process. Thus, the length PL of the addendum region P in the tooth depth direction to be cut may be defined in a range substantially 0.1-0.5 mm, however, the length is not limited and may be defined depending on the dimension of the tooth. Further, after cutting the addendum region P, a corner portion of the top land of the finishing die teeth T2 may be chamfered by, for example, buffing, or polishing.

A method for form rolling helical gear teeth on the outer periphery of the rod-shaped material W using the form rolling apparatus 1 will be explained as follows. First, the rod-shaped material W is supported by the support portion 20 of the form rolling apparatus 1 in the initial state. Next, the rotation positions of the round dies 35, 45 are controlled so that the first outer periphery regions A of the round dies 35, 45 face the outer periphery surface of the rod-shaped material W. Then, the first hydraulic pressure cylinder 36 and the second hydraulic pressure cylinder 46 are simultaneously actuated so as to move the first holder 31 and the second holder 41 forward. In those circumstances, the actuations of the first hydraulic pressure cylinder 36 and the second hydraulic pressure cylinder 46 are controlled by the position control device 60 so that the first holder 31 and the second holder 41 move forwards in the same speed. In response to the forward movement of the first holder 31 and the second holder 41, the first round die 35 and the second round die 45 approach the rod-shaped material W supported by the support portion 20 in the same speed from the opposite directions to each other. Then, the forming die teeth T1 formed on the first periphery regions A of the first round die 35 and the second round die 45 come in contact with the outer periphery surface of the rod-shaped material W simultaneously. Thus, the rod-shaped material W is interposed (sandwiched) between the first round die 35 and the second round die 45.

Thereafter, the first motor 34 and the second motor 44 are simultaneously actuated in a state where the forming die teeth T1 of the round dies 35, 45 are in contact with the outer periphery surface of the rod-shaped material W. Upon the actuation of the first motor 34, the first rotation shaft 32 and the first round die 35 rotate via the first speed reducer 33. Upon the actuation of the second motor 44, the second rotation shaft 42 and the second round die 45 rotate via the second speed reducer 43. In those circumstances, the rotation direction and the rotation speed of the first motor 34 and the second motor 44 are controlled by the rotation control device 50 so that the first round die 35 and the second round die 45 rotate in the same direction and in the same rotation speed.

Because the first round die 35 and the second round die 45 rotate in the same direction and in the same rotation speed, the rod-shaped material W interposed between the first round die 35 and the second round die 45 is co-rotated (or, dragged to rotate) in a reversal direction from the rotation direction of the round dies 35, 45 because of the frictional force generated between the first round die 35 and the second round die 45. Accordingly, the forming process starts.

During the forming process, the actuations of the first motor 34 and the second motor 44 are controlled by the rotation control device 50 so that the forming die teeth T1 formed on the first outer periphery regions A of the round dies 35, 45 contact the outer periphery of the rod-shaped material W. Further, during the forming process, the actuations of the first hydraulic pressure cylinder 36 and the second hydraulic pressure cylinder 46 are controlled by the position control device 60 so that the distance of axes between the first round die 35 and the rod-shaped material W and the distance of axes between the second round ide 45 and the rod-shaped material W are gradually reduced in the same speed. Thus, during the forming process, the forming die teeth T1 formed on the first outer periphery region A are pushed onto (penetrate) the rod-shaped material W at the outer periphery surface of the rod-shaped material W in a radially inward direction. By applying the deformation processing on the outer periphery of the rod-shaped material W by the penetrating force generated during the forming process, a helical gear (generated gear teeth) is formed on the outer periphery of the rod-shaped material W.

The forming process is performed until a penetration amount of the forming die teeth T1 onto the rod-shaped material W reaches a predetermined amount. When the penetration amount reaches the predetermined amount, the forming process is completed. Thereafter, the first motor 34 and the second motor 44 are rotated so that the outer periphery surface of the rod-shaped material W comes in contact with the second outer periphery regions B of the round dies 35, 45. Further, the forward movement of the first holder 31 by the actuation of the first hydraulic pressure cylinder 36 and the forward movement of the second holder 41 by the actuation of the second hydraulic pressure cylinder 46 are stopped, and the distance of axes between the first round die 35 and the rod-shaped material W and the distance of axes between the second round die 45 and the rod-shaped material W are fixed. Then, the finishing die teeth T2 formed on the second outer periphery regions B of the round dies 35, 45 are engaged with the generated gear teeth of the rod-shaped material W, and the round dies 35, 45 are rotated in that state. Accordingly, the finishing process starts.

In the finishing process, the actuations of the first motor 34 and the second motor 44 are controlled by the rotation control device 50 so that the finishing die teeth T2 formed on the second outer periphery regions B of the round dies 35, 45 are engaged with the generated gear teeth formed on the outer periphery of the rod-shaped material W to be rotated. In the finishing process, the tooth surface precision of the generated gear teeth is enhanced by abrading the tooth surface of the generated gear teeth by the finishing die teeth T2. When the performing time of the finishing process reaches a predetermined set time, the actuations of the first motor 34 and the second motor 44 are stopped, and the first holder 31 and the second holder 41 are retracted by actuating the first hydraulic pressure cylinder 36 and the second hydraulic pressure cylinder 46. Accordingly, the round dies 35, 45 are separated from the rod-shaped material W. Then, the rod-shaped material W applied with the form rolling is removed from the support portion 20. Accordingly, the gear teeth (form rolled gear teeth; generated gear teeth) are formed on the outer periphery surface of the rod-shaped material W by the form rolling.

Figure 7:
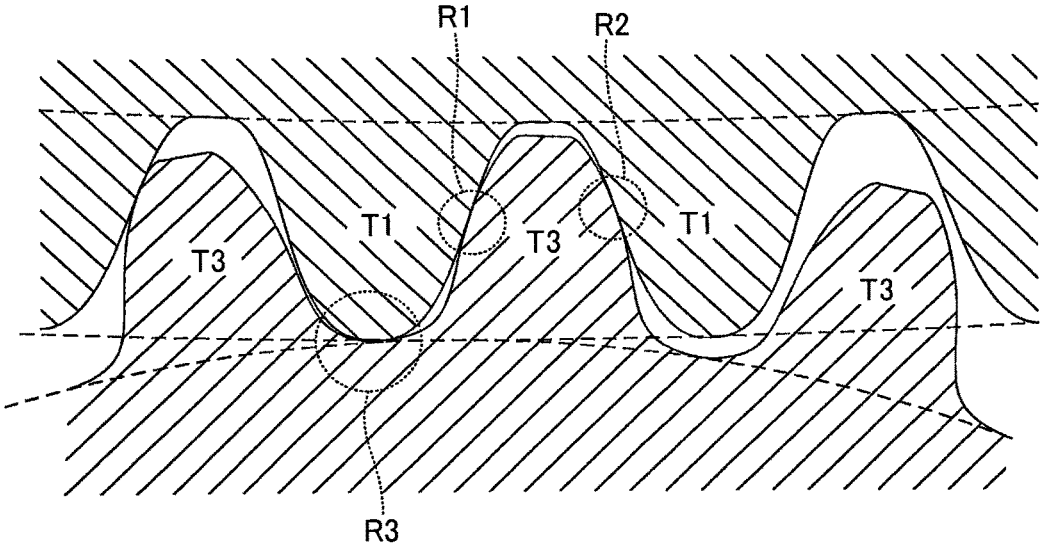
FIG. 7 shows an engaged state of the forming die at an ending period of a forming process and a generated gear teeth formed on an outer periphery of a rod-shaped material.

FIG. 7 shows the engagement of the forming die teeth T1 and the generated gear teeth T3 generated on the outer periphery of the rod-shaped material W at the ending period of the forming process. As indicated with portions R1, R2 in FIG. 7, the forming die tooth T1 and the generated gear tooth T3 are engaged with no backlash. Further, during the forming process, because the forming die tooth T1 is pushed onto (penetrates) the generated gear tooth T3, as indicated with a portion R3 in FIG. 7, the addendum of the forming die tooth T1 comes to contact a bottom land of the generated gear tooth T3.

According to the in-feed form rolling, on or after generating the tooth (teeth) in the forming process, two types of contact states, the gear meshing contact state in which the forming die teeth T1 and the generated gear teeth T3 generated on the outer periphery of the rod-shaped material W are engaged to rotate (are rotated in the engaged state; are engaged and rotated) and the rolling contact with friction state in which the rod-shaped material W rolls in a state where the addendum of the forming die tooth T1 is in contact with the bottom land of the generated gear tooth T3, are simultaneously established. In a case where the different contact states described above are simultaneously established, periodic fluctuation of the drive torque of the round dies 35, 45 is occurred, and undulation is generated at the tooth trace of the produced generated gear tooth T3 because of the fluctuation of the drive torque. That is, according to the forming process, because of the application of the penetrating force onto the bottom land of the generated gear tooth T3 by the addendum of the forming die teeth T1 while the forming die teeth T1 and the generated gear teeth T3 are meshed and rotated, the undulation is generated at the tooth trace of the generated gear teeth T3. In those circumstances, by stopping the penetrating operation of the forming die teeth T1 after the generation of the generated gear teeth T3 and by applying the finishing process of the generated gear teeth T3 using the forming die teeth T1 the undulation of the tooth trace is slightly corrected, however, the correction is not sufficient. In response to the foregoing phenomenon, according to the embodiment, the generated gear teeth are applied with the finishing process using the finishing die teeth T2 having the same configuration with the forming die teeth T1 except the addendum.

Figure 8:
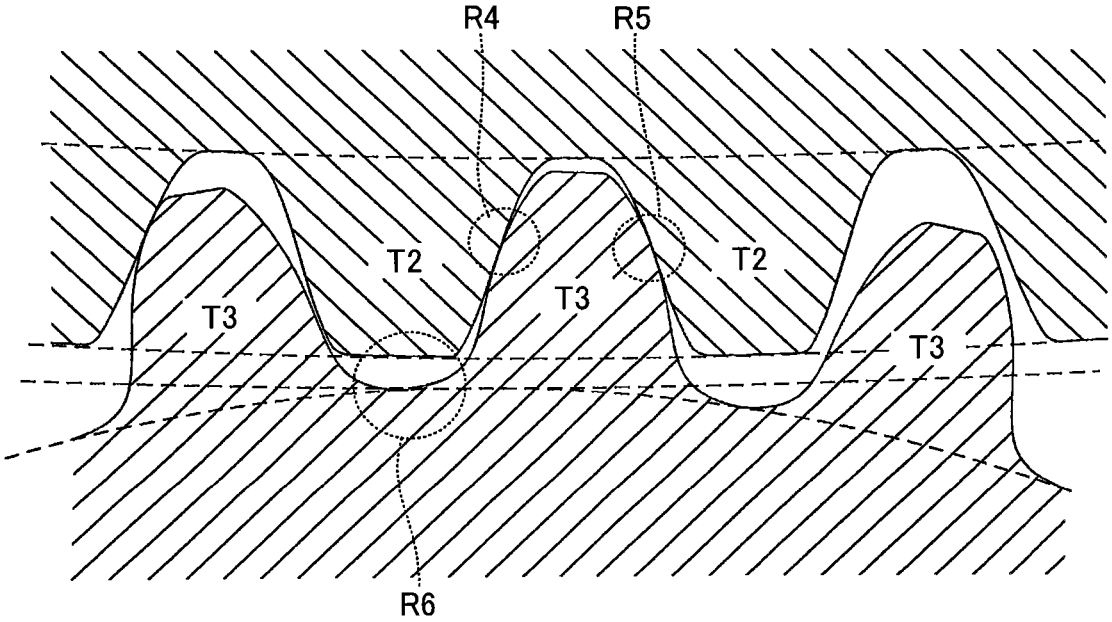
FIG. 8 shows an engaged state of the finishing die during a finishing process and the generated gear teeth formed on the outer periphery of the rod-shaped material.

FIG. 8 shows the engaged state of the finishing die teeth T2 and the generated gear teeth T3 formed on the outer periphery of the rod-shaped material W during the finishing process. The finishing die tooth T2 has the same configuration with the forming die tooth T1 except the addendum. Thus, in the finishing process, similarly to the forming process, the finishing die teeth T2 engages with the generated gear teeth T3 with no backlash. On the other hand, because the tooth depth H2 of the finishing die teeth T2 is shorter than the tooth depth H1 of the forming die teeth T1, the tooth depth H2 of the finishing die teeth T2 is shorter than the tooth depth of the generated gear teeth T3 generated by the forming die teeth T1. Thus, as indicated with a portion R6 in FIG. 8, the addendum of the finishing die teeth T2 does not contact the bottom land of the generated gear teeth T3 in the finishing process.

Namely, in the finishing process, the contact state of the finishing die teeth T2 and the generated gear teeth T3 corresponds to the gear meshing contact state, and the rolling contact with friction state is not established. Thus, large penetrating force (thrust force) is not applied to the generated gear teeth T3. Accordingly, the fluctuation of the drive torque of the round dies 35, 45 that is caused by the penetrating force is reduced. In consequence, the undulation of the tooth trace is sufficiently corrected. In addition, because the finishing die teeth T2 and the generated gear teeth T3 are engaged with each other with no backlash during the finishing process, the deterioration of the precision in forming caused by the generation of the backlash can be avoided. Accordingly, the undulation of the tooth trace can be further reduced.

Figure 9:
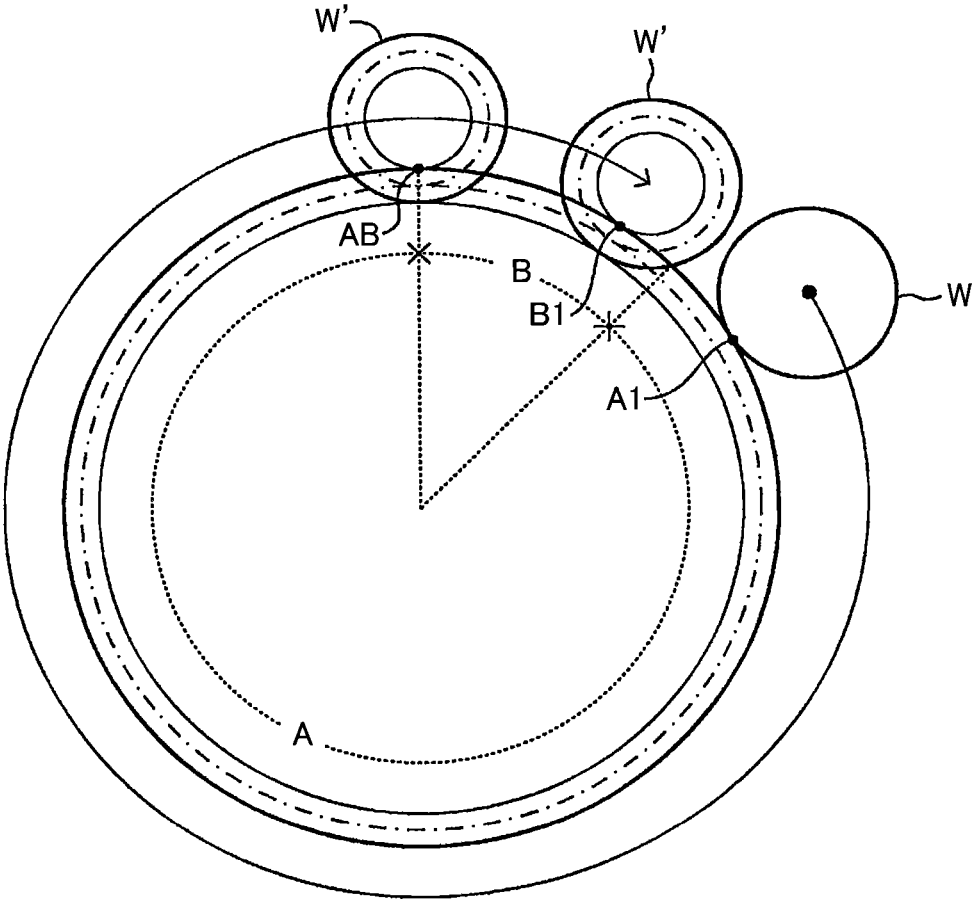
FIG. 9 shows a rolling locus of the rod-shaped material on a round die during the forming process and the finishing process.

FIG. 9 shows a rolling locus of the rod-shaped material W on round dies 35, 45 during the forming process and the finishing process. At the beginning of the forming process, the outer periphery surface of the rod-shaped material W comes to contact the round dies 35, 45 at the position indicated with A1 (see FIG. 9) in the first outer periphery region A. From the position A1, the round die 35, 45 rolls on the first outer periphery region A in the clockwise direction as indicated with an arrow in FIG. 9. The forming process is performed by the rod-shaped material W rolling on the first outer periphery region A. In the progress of the forming process, the gear teeth (generated gear teeth) is generated on the outer periphery of the rod-shaped material W. A rod-shaped material W' on which the generated gear teeth are generated reaches a boarder position AB between the first outer periphery region A and the second outer periphery region B. When the rod-shaped material W' reaches the boarder position AB, the forming process is completed. Thereafter, the rod-shaped material W' rolls on the second outer periphery region B in the clockwise direction. The finishing process is performed by the rod-shaped material W' rolling on the outer periphery region B. Then, when the rod-shaped material W' reaches the position indicated with B1 in the outer periphery region B of the round die 35, 45, the finishing process is completed. Accordingly, the forming process and the finishing process are performed consecutively.

Figure 10:
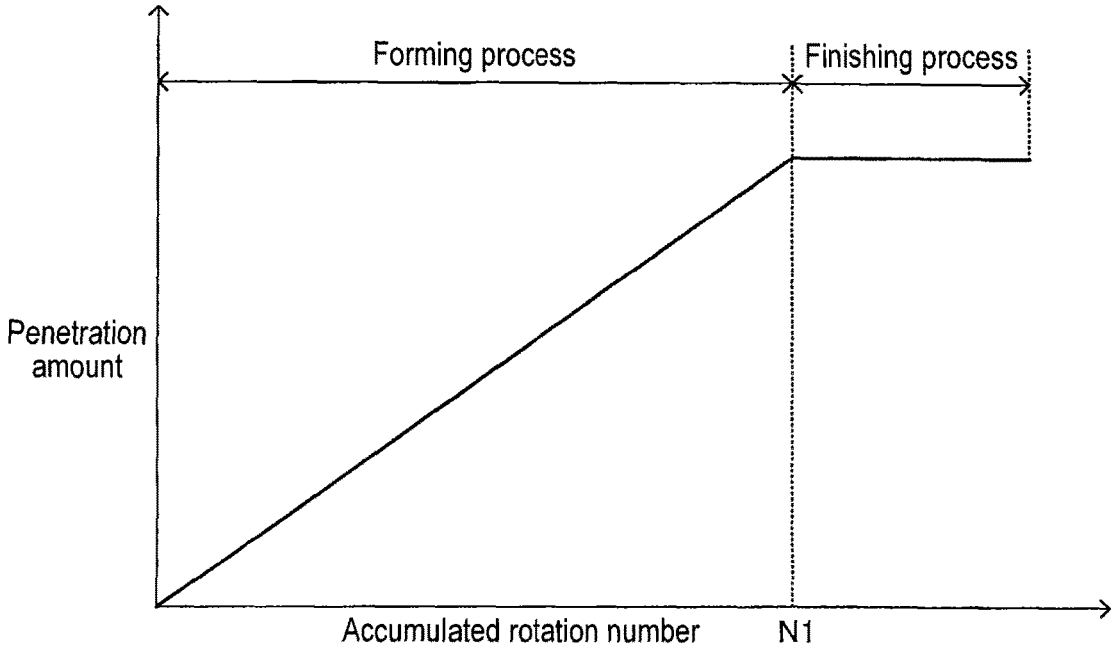
FIG. 10 is a graph showing a relationship of an accumulated rotation number of the rod-shaped material and a penetration amount (thrust amount) of a die tooth onto an outer peripheral surface of the rod-shaped material.

FIG. 10 shows a graph showing a relationship of an accumulated rotation number of the rod-shaped material W and a penetration amount (thrust amount) of a die tooth onto the outer peripheral surface of the rod-shaped material W. The accumulated rotation number of the rod-shaped material W shows a moving distance (rolling distance) of the rod-shaped material W on the round die 35, 45 from the beginning of the form rolling (from the start of the forming process).

As illustrated in FIG. 10, the forming process is performed until the accumulated rotation number of the rod-shaped material W from the start of form rolling reaches N1. That is, the rod-shaped material W rolls on the first outer periphery region A of the round die 35, 45. In those circumstances, the penetration amount increases as the accumulated rotation number of the rod-shaped material W increments. Accordingly, the penetrating force (thrust force) of the forming die teeth T1 is applied on the outer periphery surface of the rod-shaped material W during the forming process. The generated gear tooth (teeth) T3 is generated on the outer periphery surface of the rod-shaped material W by the penetrating force.

When the accumulated rotation number of the rod-shaped material W reaches N1, the finishing process is performed. That is, the rod-shaped material W rolls on the second outer periphery region B of the round dies 35, 45. In those circumstances, the penetrating force (thrust force) does not change. That is, the penetrating force does not affect the rod-shaped material W. Further, as described above, the addendum of the finishing die teeth T2 does not come to contact the bottom land of the generated gear teeth T3. Accordingly, the undulation of the tooth trace of the generated gear teeth T3 generated by the application of the penetrating force onto the rod-shaped material W during the forming process is corrected during the finishing process. Thus, the precision in forming the generated gear teeth T3 is enhanced.

Figure 11:
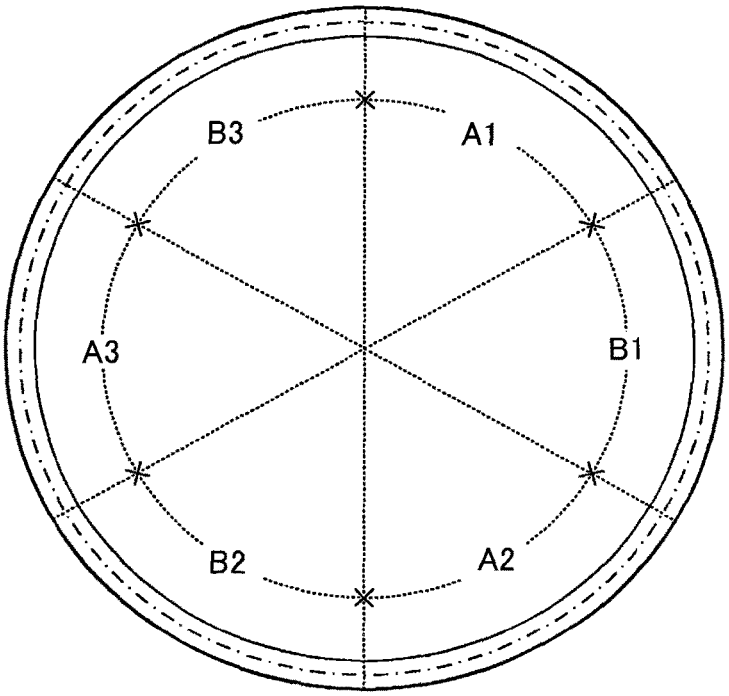
FIG. 11 is a front view of a round die according to a modified example of the embodiment.

A modified example will be explained as follows. FIG. 11 shows a front view of a round die according to the modified example of the embodiment. On an outer periphery surface of the round die of the modified example, plural first outer periphery regions A and plural second outer periphery regions B are formed alternately in a circumferential direction. More particularly, the first outer periphery region A includes an outer periphery region A1, an outer periphery region A2, and an outer periphery region A3, and the second outer periphery region B includes an outer periphery region B1, an outer periphery region B2, and an outer periphery region B3. The outer periphery region A1, the outer periphery region B1, the outer periphery region A2, the outer periphery region B2, the outer periphery region A3, and the outer periphery region B3 are formed on the outer periphery of the round die are arranged in the mentioned order in the clockwise direction. The circumferential lengths of the outer periphery regions A1, A2, A3 are the same. The circumferential lengths of the outer periphery regions B1, B2, B3 are the same. The forming die teeth T1 with the same configuration from one another are formed on the outer periphery regions A1, A2, A3, respectively. The finishing die teeth T2 with the same configuration from one another are formed on the outer periphery regions B1, B2, B3, respectively.

Figure 12:
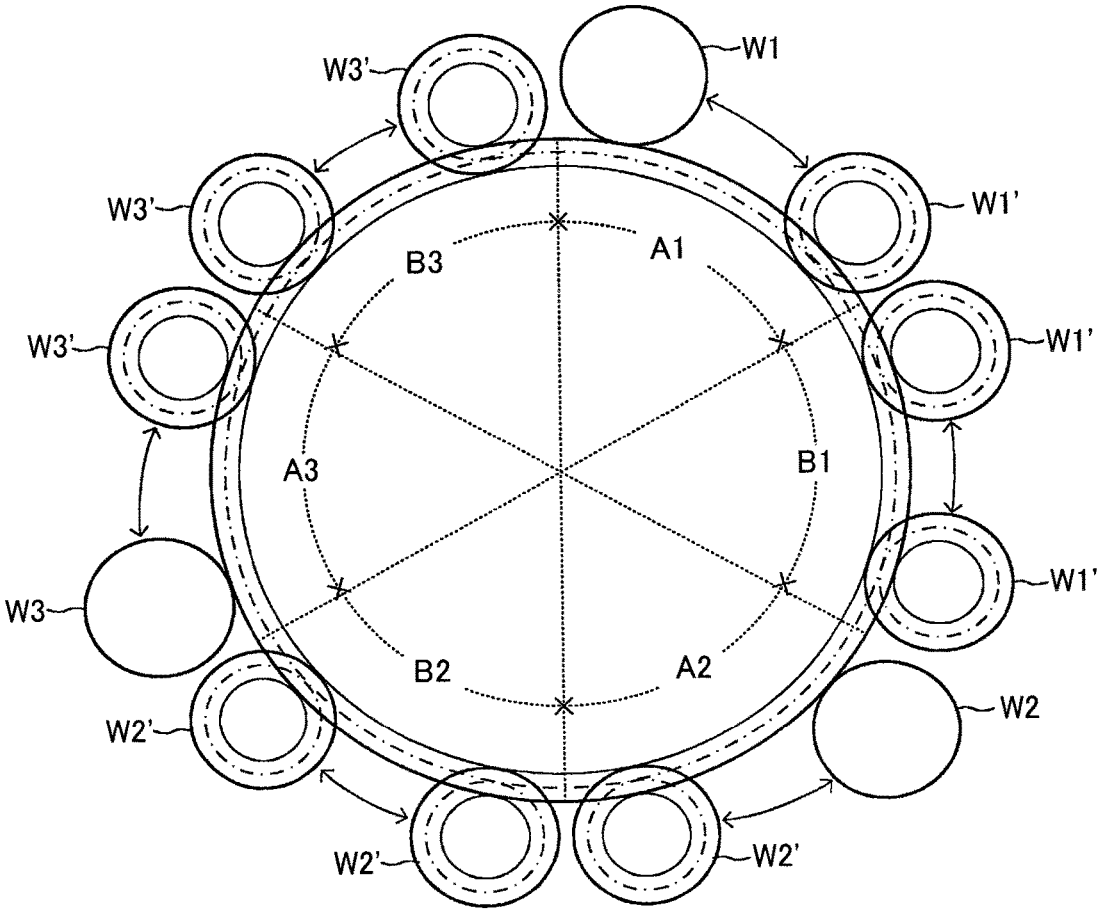
FIG. 12 shows a positional relationship of the round dies and rod-shaped materials in case of form rolling using the round dies shown in FIG. 11.

In case of form rolling the helical gear teeth (helical generated gear teeth) on the outer periphery of the rod-shaped material using the round die shown in FIG. 11, for example, as illustrated in FIG. 12, the outer periphery surfaces of three rod-shaped materials W1, W2, W3 are come to contact the outer periphery regions A1, A2, A3, respectively. Then, the rod-shaped materials W1, W2, W3 roll on the outer periphery regions A1, A2, A3, respectively, and the form die teeth T1 are gradually pushed into (gradually penetrate) the rod-shaped materials W1, W2, W3 in a radially inward direction. In those circumstances, the rotational direction of the round die is controlled so that the rolling direction of the rod-shaped materials W1, W2, W3 reverses, that is, the rod-shaped materials W1, W2, W3 move both ways in the clockwise direction (CW direction) and the counterclockwise direction (CCW direction). Accordingly, the gear teeth (generated gear teeth) are generated on the outer periphery of each of the rod-shaped materials W1, W2, W3 (forming process).

After the penetration amount (thrust amount) of the forming die teeth T1 penetrating onto the rod-shaped materials W1, W2, W3 reaches a predetermined amount, the rod-shaped materials W1', W2', W3' on which the generated gear teeth are generated at the outer periphery surfaces, respectively, are moved to the outer periphery regions B1, B2, B3 and are rolled on the outer periphery regions B1, B2, B3, respectively. In those circumstances, the rotational direction of the round die is controlled so that the rolling direction of the rod-shaped materials W1', W2', W3' is reversed. Accordingly, the precision of the generated gear teeth formed on the outer periphery surface of the rod-shaped materials W1', W2', W3' is enhanced. After the rod-shaped materials W1', W2', W3' move on the outer periphery regions B1, B2, B3, respectively, in the clockwise direction and the counterclockwise direction by predetermined times, the finishing process is completed.

Figure 13:
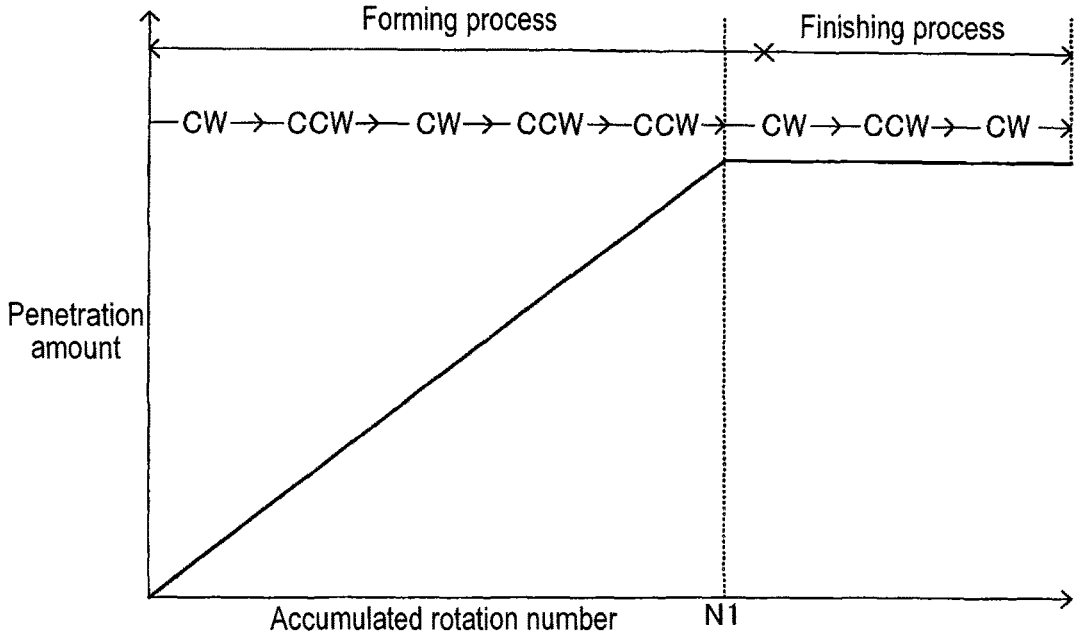
FIG. 13 is a graph showing a relationship of an accumulated rotation number of the rod-shaped material and a penetration amount (thrust amount) of a die tooth onto an outer peripheral surface of the rod-shaped material in case of performing the forming process and the finishing process using the round dies according to the modified example of the embodiment.

FIG. 13 is a graph showing a relationship of an accumulated rotation number of the rod-shaped material W1, W2, W3 and a penetration amount (thrust amount) of a die tooth penetrating onto an the rod-shaped material W1, W2, W3 in case of performing the forming process and the finishing process using the round dies according to the modified example of the embodiment. As illustrated in FIG. 13, the forming process is performed from the start of the form rolling until the accumulated rotation number of the rod-shaped material reaches N1. That is, the rod-shaped materials W1, W2, W3 roll on the first outer periphery regions A of the round dies 35, 45. In those circumstances, the penetration amount (thrust amount) increases as the accumulated rotation number of the rod-shaped materials W1, W2, W3 increments. Accordingly, the penetrating force (thrust force) of the forming die teeth T1 is applied to the outer periphery surface of the rod-shaped materials W1, W2, W3 during the forming process. By the penetrating force (thrust force), the generated gear teeth T3 are generated on the outer periphery of the rod-shaped materials W1, W2, W3.

After the accumulated rotation number of the rod-shaped materials W1, W2, W3 reaches N1, the finishing process is performed. During the finishing process, the penetration amount (thrust amount) does not change. That is, the penetrating force (thrust force) is not applied to the rod-shaped materials W1', W2', W3' during the finishing process. Further, similarly to the embodiment, the addendum of the finishing die teeth does not come in contact with the bottom land of the generated gear teeth. Thus, the undulation of the tooth trace of the generated gear teeth that are generated by the application of the penetrating force (thrust force) onto the rod-shaped materials W1', W2', W3' during the forming process is corrected during the finishing process. Accordingly, the precision in forming the generated gear teeth is enhanced.

Further, as shown in FIG. 13, the rotational direction of the rod-shaped materials W1, W2, W3 is changed to reverse in both of the forming process and the finishing process. Thus, by the reversal rotation of the rod-shaped materials W1, W2, W3, the precision of the configuration of the tooth surfaces of the generated gear teeth can be enhanced. Further, according to the modified example of the embodiment, plural (e.g., three in the example) rod-shaped materials can be processed with the form rolling using a single round die. Still further, abrasion amount in the circumferential direction of the round die can be even (the round die can be worn away evenly in the circumferential direction).

As described above, the form rolling apparatus 1 of the embodiment forms helical gear teeth (helical generated gear teeth) on the outer periphery surface of the rod-shaped material by the in-feed form rolling. The from rolling apparatus 1 includes the support portion 20 supporting the rod-shaped material W to be axially rotatable, round dies 35, 45 being rotatable about rotation shafts (axes) which are in parallel with an axial direction of the rod-shaped material W supported by the support portion 20, the round dies 35, 45 positioned so that die teeth face the outer periphery surface of the rod-shaped material W supported by the support portion 20, the first motor 34 and the second motor 44 actuating the round dies 35, 45, respectively, to rotate, and first hydraulic pressure cylinder 36 and the second hydraulic pressure cylinder 46 that move the round dies 35, 45, respectively, in the direction orthogonal to the axial direction of the rotation shafts (axes) of the round dies 35, 45 (X-direction) so that the distance of axes between the first round die 35 and the rod-shape member W supported by the support portion 20 and between the second round die 45 and the rod-shaped material W supported by the support portion 20 change. Further, the die teeth includes the forming die teeth T1 for generating the generated gear teeth T3 on the outer periphery surface of the rod-shaped material W and the finishing die teeth T2 that enhances the tooth surface precision of the generated gear teeth T3 by engaging with the generated gear teeth T3 and rotating. The finishing die teeth T2 is formed in the configuration so that the addendum of the finishing die teeth T2 does not contact the bottom land of the generated gear teeth T3. Further, the tooth depth of the finishing die teeth T2 is shorter than the tooth depth of the forming die teeth T1. Still further, the finishing die teeth T2 is formed by removing (cutting) the addendum region P including the top land from the tooth having the same configuration with the forming die tooth T1.

Further, the form rolling method of the embodiment includes the forming process for generating the gear teeth (generated gear teeth) on the outer periphery surface of the rod-shaped material W by the forming die teeth T1 penetrating the rod-shaped material W in a radially inward direction at the outer periphery surface while rotating the round dies 35, 45 in a state where the forming die teeth (tooth) T1 formed on the outer periphery of the round dies 35, 45 are (is) in contact with the outer periphery surface of the rotatably supported rod-shaped material W, and the finishing process for enhancing the tooth surface precision of the generated gear teeth T3 by engaging the finishing die teeth T2 formed on the outer periphery of the round dies 35, 45 with the generated gear teeth T3 generated on the outer periphery surface of the rod-shaped material W and by rotating the round dies 35, 45 in the engaged state. In the finishing process, the finishing die teeth T2 and the generated gear teeth T3 are engaged so that the addendum of the finishing die teeth T2 does not contact the bottom land of the generated gear teeth T3.

According to the embodiment, the forming die teeth T1 and the finishing die teeth T2 having different configurations are formed on the outer periphery of each of the round dies 35, 45 which is applied to in-feed form rolling. The forming die teeth T1 are applied for generating the generated gear teeth T3 (during the forming process), and the finishing die teeth T2 are applied for finishing the generated gear teeth T3 (during the finishing process). Further, the finishing die teeth T2 is formed so that the addendum does not come to contact the bottom land of the generated gear teeth T3. Thus, during the finishing process, the addendum of the finishing die teeth T2 does not contact the bottom land of the generated gear teeth T3, and the penetrating force by the round die 35, 45 does not affect the rod-shaped material W. Accordingly, the level of the periodic fluctuation of the torque generated by the known in-feed form rolling can be reduced, and the undulation of the tooth trace generated by the torque fluctuation can be sufficiently corrected.

Further, according to the form rolling apparatus 1 of the embodiment, the finishing die teeth T2 are configured to engage with the generated gear teeth T3 with no backlash. Similarly, according to the form rolling method of the embodiment, in the finishing process, the finishing die teeth T2 are engaged with the generated gear teeth T3 with no backlash. Accordingly, the deterioration of the tooth surface precision because of the backlash can be avoided. Thus, the tooth surface precision of the generated gear teeth can be further enhanced.

Figure 14:
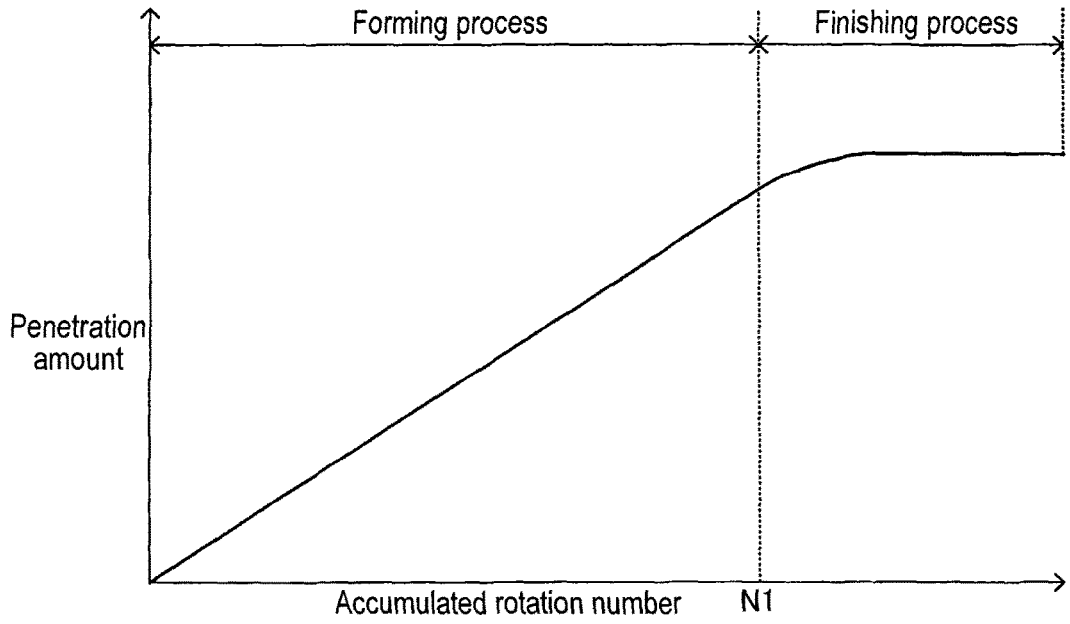
FIG. 14 is a graph showing a relationship between an accumulated rotation number of the rod-shaped material and penetration amount (thrust amount) of a die tooth onto an outer peripheral surface of the rod-shaped material according to another example.

The disclosure of the form rolling apparatus and the form rolling method is not limited to the embodiment described above. For example, according to the embodiment, penetrating force is applied to the rod-shaped material W in the forming process and the penetrating force is not applied to the rod-shaped material W in the finishing process, however, according to an alternative construction, the penetrating force may be applied to the rod-shaped material W at an initial stage of the finishing process as shown in FIG. 14. That is, as long as the penetrating force is not applied to the rod-shaped material W at the final stage of the finishing process, application of the penetrating force during the process is allowable. Further, according to the embodiment, a form rolling of a rod-shaped material using a pair of dies is explained, however, according to an alternative construction, a rod-shaped material may be formed by form rolling using a single die.

The disclosure provides a form rolling apparatus for applying in-feed form rolling to an outer periphery surface of a rod-shaped material (W) to generate helical gear teeth. The form rolling apparatus includes a support portion (20) configured to support the rod-shaped material (W) to be axially rotatable, a round die (35, 45) formed with die teeth (T1, T2) on an outer periphery thereof, the round die (35, 45) being rotatable about a rotational axis which is configured to be arranged in parallel with an axial direction of the rod-shaped material (W) configured to be supported by the support portion (20), the die teeth (T1, T2) configured to be positioned facing the outer periphery surface of the rod-shaped material (W) configured to be supported by the support portion (20), a rotation drive device (34, 44) rotationally actuating the round die (35, 45), and a moving device (first hydraulic pressure cylinder 36, second hydraulic pressure cylinder 46) moving the round die (35, 45) in a direction orthogonal to the rotational axis of the round die (35, 45) so that a distance of axes of the round die (35, 45) and the rod-shaped material (W) changes. The die teeth (T1, T2) includes forming die teeth (T1) for generating the gear teeth (T3) on the outer periphery surface of the rod-shaped material (W) and finishing die teeth (T2) enhancing a tooth surface precision of the generated gear teeth (T3) by engaging with the generated gear tooth (T3) and rotating. The finishing die teeth are formed in a configuration each having an addendum that does not come to contact a bottom land of the generated gear teeth (T3).

According to the form rolling apparatus (1) of the disclosure, the forming die teeth (T1) and the finishing die teeth (T2) are provided on the outer periphery of the round die (35, 45), the forming die teeth (T1) is applied when generating the generated gear teeth (T3) on the outer periphery surface of the rod-shaped material (W) and the finishing die teeth (T2) is applied for enhancing the tooth surface precision of the generated gear teeth (T3). The finishing die teeth (T2) is formed so that the addendum of the finishing die tooth (T2) does not contact the bottom land of the generated gear teeth. According to this construction, when applying the finishing die teeth (T2), the addendum of the finishing die teeth (T2) does not come to contact the bottom land of the generated gear teeth. Accordingly, the undulation of a tooth trace of the generated gear teeth that is generated on the rod-shaped material (W) by the application of the forming die teeth (T1) can be corrected by the application of the finishing die teeth (T2), and thus the precision for forming the generated gear teeth is enhanced.

According to the embodiment, the finishing die (T2) includes a tooth depth that is shorter than a tooth depth of the forming die teeth (T1).

According to the construction of the disclosure, when applying the finishing die teeth (T2), the addendum of the finishing die teeth (T2) does not come to contact the bottom land of the generated gear teeth. Accordingly, the undulation of a tooth trace of the generated gear teeth that is generated on the rod-shaped material (W) by the application of the forming die teeth (T1) can be corrected by the application of the finishing die teeth (T2), and thus the precision for forming the generated gear teeth is enhanced.

According to the embodiment, each tooth of the finishing die teeth (T2) is formed by removing an addendum region including a top land from a tooth having a same configuration with a tooth of the forming die teeth (T1).

According to the construction of the disclosure, the round die (35, 45) formed with the forming die teeth (T1) and the finishing die teeth (T2) can be readily manufactured.

According to the embodiment, the finishing die teeth (T2) are formed to engage with the generated gear tooth (T3) with no backlash.

In order not to apply the penetrating force from the die teeth (T2) to the rod-shaped material (W) during the finishing stage, for example, a relative position of the die teeth and the generated gear teeth is adjusted to provide a clearance between the die teeth and the generated gear teeth, for example. However, because the clearance forms a backlash, a tooth surface precision of the generated gear teeth is deteriorated or a burr may be generated. In response to the drawback, According to the embodiment, the finishing die teeth and the generated gear tooth are engaged with no backlash and the penetrating force is not applied to the rod-shaped material even in the finishing stage. Accordingly, the tooth surface precision of the generated gear teeth can be further enhanced.

According to the embodiment, a form rolling method for applying in-feed form rolling to an outer periphery surface of a rod-shaped material (W) to form helical gear teeth (T3), the form rolling method includes a forming process for generating the gear teeth (T3) on the outer periphery surface of the rod-shaped material (W) by forming die teeth (T1) which are formed on an outer periphery of a round die (35, 45) penetrating in a radially inward of the rod-shaped material (W) at the outer periphery surface of the rod-shaped material (W) while rotating the round die (35, 45) in a state where the forming die teeth (T1) are in contact with the outer periphery surface of the rod-shaped material (W) which is rotatably supported, and a finishing process for enhancing a tooth surface precision of the generated gear teeth (T3) by rotating the round die (35, 45) in a state where finishing die teeth (T2) formed on the outer periphery of the round die (35, 45) are engaged with the generated gear teeth (T3) generated on the outer periphery surface of the rod-shaped material (W). The finishing die teeth (T2) and the generated gear teeth (T3) are engaged so that an addendum of each of the finishing die teeth (T2) does not come to contact a bottom land of the generated gear teeth (T3) in the finishing process.

Generally, according to the in-feed form rolling, as the penetration amount of a round die to a rod-shaped material increases, periodic changes in a rotation torque of the round die are observed. Undulation of a tooth trace of generated gear teeth is considered to be generated because of the periodic torque fluctuation (see FIG. 22 in non-patent reference 2). Further, in a case where an addendum of the round die is in contact with a bottom land of the generated gear teeth generated on the rod-shape material, the rod-shaped material is affected by (receives) the penetrating force from the round die to cause the periodic torque fluctuation even in a state where the penetrating operation of the round die to the rod-shaped member is stopped at a finishing stage. Consequently, the undulation of the tooth trace on the generated gear teeth is not sufficiently corrected.

According to the embodiment, the forming die teeth (T1) and the finishing die teeth (T2), that are two die teeth with different configurations, are formed on the outer periphery of the round die (35, 45). The forming die teeth are applied when generating the generated gear teeth (during the forming process). The finishing die teeth (T2) are applied when finishing the generated gear teeth (during the finishing process). In those circumstances, the finishing die is formed so that the addendum does not contact the bottom land of the generated gear teeth. Accordingly, during the finishing, the addendum of the die teeth (T2) does not contact the bottom land of the generated gear teeth, thus, the penetrating force applied to the rod-shaped material by the round die (35, 45) during the finishing process is reduced. Consequently, the periodic torque fluctuation can be reduced, and the undulation of the tooth trace can be sufficiently corrected.

According to the embodiment, the finishing die teeth (T2) and the generated gear tooth (T3) are engaged with no backlash in the finishing process.

According to the construction of the embodiment, the deterioration of the precision in forming the generated gear teeth because of the generation of the backlash is avoided and the undulation of the tooth trace can be further reduced.

According to the embodiment, the tooth depth of the finishing die teeth (T2) is formed to be shorter than the tooth depth of the generated gear teeth which is formed by the forming die teeth by the form rolling.

According to the embodiment, the form rolling apparatus (1) includes the rotation control device (50) for controlling the rotation drive device (first motor 34, second motor 44) so that the forming die teeth (T1) comes to contact the outer periphery surface of the rod-shaped material (W) during the forming process during which the gear teeth are generated on the outer periphery surface of the rod-shaped material and so that the generated gear teeth and the finishing die teeth are engaged during the finishing process during which the tooth surface precision of the generated gear teeth is enhanced.

According to the embodiment, the form rolling apparatus (1) includes the position control device (60) for controlling the moving device (first hydraulic pressure cylinder 36, second hydraulic pressure cylinder 46) so that the distance of axes between the round die (35, 45) and the rod-shaped material (W) are reduced during the forming process during which the gear teeth (generated gear teeth) is generated on the outer periphery surface of the rod-shaped material (W). In those circumstances, the position control device (60) controls the moving device (first hydraulic pressure cylinder 36, second hydraulic pressure cylinder 46) so that the distance of axes between the between the round die (35, 45) and the rod-shaped material (W) does not change during the finishing process during which the tooth surface precision of the generated gear teeth is enhanced.

According to the embodiment, the forming die teeth are formed to be engaged with the generated gear teeth with no backlash.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A form rolling apparatus for applying in-feed form rolling to an outer periphery surface of a rod-shaped material to generate helical gear teeth, the form rolling apparatus comprising:

a support portion configured to support the rod-shaped material to be axially rotatable;

a round die formed with die teeth on an outer periphery thereof, the round die being rotatable about a rotational axis which is configured to be arranged in parallel with an axial direction of the rod-shaped material configured to be supported by the support portion, the die teeth configured to be positioned facing the outer periphery surface of the rod-shaped material configured to be supported by the support portion;

a rotation drive device rotationally actuating the round die; and a moving device moving the round die in a direction orthogonal to the rotational axis of the round die so that a distance of axes of the round die and the rod-shaped material changes;

wherein the die teeth includes forming die teeth for generating the gear teeth on the outer periphery surface of the rod-shaped material and finishing die teeth enhancing a tooth surface precision of the generated gear teeth by engaging with the generated gear tooth and rotating; and wherein the finishing die teeth each have an addendum region that is less than an addendum region of the forming die teeth by a predetermined length.

2. The form rolling apparatus according to claim 1, wherein the finishing die teeth include a tooth depth that is shorter than a tooth depth of the forming die teeth.

3. The form rolling apparatus according to claim 1, wherein a dedendum region of the finishing die teeth is the same as a dedendum region of the forming die teeth.

4. The form rolling apparatus according to claim 1, wherein the finishing die teeth and the forming die teeth have a same tooth profile except for the respective addendum regions of the finishing die teeth and the forming die teeth.

5. The form rolling apparatus according to claim 1, wherein the addendum region of the finishing die teeth is the same as the addendum region of the forming die teeth except for a cut portion extending from a top land of the forming die teeth by the predetermined length.

* * * * *